US010036132B2

(12) United States Patent
Sicking

(10) Patent No.: US 10,036,132 B2
(45) Date of Patent: Jul. 31, 2018

(54) TWIST BOX GUARDRAIL TERMINAL

(71) Applicant: Dean L. Sicking, Birmingham, AL (US)

(72) Inventor: Dean L. Sicking, Birmingham, AL (US)

( * ) Notice: Subject to any disclaimer, the term of this patent is extended or adjusted under 35 U.S.C. 154(b) by 734 days.

(21) Appl. No.: 14/469,007

(22) Filed: Aug. 26, 2014

(65) Prior Publication Data

US 2016/0060831 A1 Mar. 3, 2016

Related U.S. Application Data

(60) Provisional application No. 61/959,488, filed on Aug. 26, 2013.

(51) Int. Cl.
*E01F 15/14* (2006.01)
*E01F 15/04* (2006.01)

(52) U.S. Cl.
CPC ..... *E01F 15/143* (2013.01); *E01F 15/0423* (2013.01)

(58) Field of Classification Search
CPC ... E01F 15/04; E01F 15/0407; E01F 15/0423; E01F 15/14; E01F 15/143; E01F 15/145; E01F 15/146
See application file for complete search history.

(56) References Cited

U.S. PATENT DOCUMENTS 4,928,928 A 5/1990 Buth
5,797,591 A 8/1998 Krage
6,220,575 B1 4/2001 Lindsay
6,719,483 B1 * 4/2004 Welandsson ..... E01F 15/0476 256/13.1
6,932,327 B2 8/2005 Alberson
7,694,941 B2 * 4/2010 Abu-Odeh ..... E01F 15/143 256/13.1
7,699,293 B2 4/2010 James
7,883,075 B2 2/2011 Abu-Odeh
8,905,382 B2 * 12/2014 Smith ..... E01F 15/143 256/13.1
9,453,312 B2 * 9/2016 James ..... E01F 15/02
2007/0252124 A1 11/2007 Heimbecker
2009/0272956 A1 11/2009 Abu-Odeh

FOREIGN PATENT DOCUMENTS

WO WO 2010/139027 * 12/2010 ..... E01F 15/04

* cited by examiner

*Primary Examiner* — Michael P Ferguson

(74) *Attorney, Agent, or Firm* — Studebaker & Brackett PC

(57) ABSTRACT

This guardrail terminal design incorporates an impact head of open front configuration adapted with the rear portion as a funnel disposed with the narrow end of the funnel facing forward which will flatten the W beam guardrail as it moves down the beam when impacted by a vehicle. Tension is maintained on the beam by flat strips connected from the beam through top open front of the impact head and is attached to a front anchor post. A wedge shaped reverse direction bracket with slotted bolt holes such that the slots open toward the traffic direction disposed at the back of the impact head where it connects to the guardrail will allow for reverse direction impacts to be accounted for.

13 Claims, 5 Drawing Sheets

TWIST BOX GUARDRAIL TERMINAL

RELATED CASES

This application is a continuation of U.S. provisional application 61/959,488 filed on Aug. 26, 2013.

BACKGROUND OF THE INVENTION

(a) Technical Field

The present invention relates to the safety treatment for the ends of highway guardrails.

(b) Background

The terminal is the end of a guardrail and is often the part of the guardrail, that when struck by a moving vehicle, transfers more energy to the vehicle and to its occupants. A guardrail terminal must serve two basic functions: (1) anchor the guardrail to allow the barrier to develop tension when struck on the traffic face and (2) mitigate the risks of serious and fatal crashes when struck on the end of the barrier. Guardrail terminals generally fall one of three categories, non-energy absorbing, energy absorbing by tension, and energy absorbing by compression terminals. Energy absorbing terminals must be designed to provide a control deceleration for vehicle striking the terminal. Energy absorbing terminals have been shown by many studies to provide greatly improved safety performance compared to non-energy absorbing systems.

Many energy absorbing guardrail terminals rely on deformation of the guardrail to dissipate energy. Guardrail deformations were controlled by impact head that either flatten, cut, or kinked the rail elements as it was pushed down the rail during impact.

Most guardrails use a rail element in the shape of a "W" beam (W beam) which, when flattened dissipates a significant amount of energy. Unfortunately, the amount of energy dissipation during rail flattening is difficult to change from a basic level. As a result, designers of guardrail terminals cannot use flattening based designs when the impacting vehicle must be brought to stop over a short distance or the forces on the impacting vehicle need to be reduced. The impact head applies a compressive load to the W beam guardrail in order to produce these deformations. However, compression loads can become excessive and cause the guardrail to buckle. The buckled guardrail can then penetrate into the passenger compartment of the vehicle and impale the occupants.

Tension-based systems have been developed that incorporate a method for restraining the end of the W beam guardrail. The impact head slides down the rail and an anchor system pulls the rail through the impact. By keeping constant tension on the W beam guardrail, buckling of the rail is minimized or prevented entirely.

U.S. Pat. No. 4,928,928 describes a guardrail end plate that functions as a compression terminal that uses flattening of the W shaped guardrail as it slides down the rail after impact of a vehicle.

U.S. Patent Application No. US 2009/0272956 A1 recites a tension method of flattening the guard rail in the vertical direction. This function is accomplished by forcing the guardrail element through a squeezer section that progressively reduces the height of the rail until it is virtually flat. Although this design does decrease impact forces, it provides a narrow range of energy dissipation. The embodiment described in this patent utilizes a channel through which the flattened rail element is pushed. Increasing the length of this channel will increase the impact force required to push the impact head down the rail. Unfortunately, this design directs the guardrail under the car and the top edge of the W beam can act as a knife and cut through vehicle components, such as a gasoline tank. Further, friction in the channel produces a force that resists impact head movement that is very close to the ground. This resisting force will produce an overturning moment that causes the impact face to lean backward and possibly allow the vehicle to vault over the top of the impact head.

U.S. Pat. No. 7,883,075 B2 recites the use of the bended impact head using stacked plates, a V-shaped cutout, and tension. This guardrail terminal modifies at least one of the support post to an upper portion, a middle portion that is weekend, and a lower portion that remains in the ground when impact sheers away the upper portion.

U.S. Pat. No. 6,173,943 B1 utilizes a flat end plate facing oncoming traffic with an array of vehicle deflecting rails secured to the support post extending along the roadway with the impact receiving element slidably mounted, a stop coupled to at least one of the impact receiving elements, the impact receiving element coupled to the first post such that impact forces on the vehicle engaging portion are applied to the first post and break the first post before the stop limits sliding of the impact receiving element relative to the first rail.

U.S. Pat. No. 6,220,575 details an impact head assembly with the first support post attached to the rail so as to create tension that increases as the support post upper portion is sheared off.

U.S. Pat. No. 7,699,293 B2 describes a guardrail cable routing means configured to form a torturous path through which a cable can be threaded. The torturous path includes a 180° turn. As the guardrail is collapsed by a vehicle, the resistance caused by the cable applies tension in the direction opposite from the direction traveled by the impacting vehicle, slowing the collision.

U.S. Pat. No. 5,797,591 describes bolting the impact head to a post mounted in the ground just in front of it and connecting it to the first post of the guardrail.

U.S. Pat. No. 5,931,448 represents this inventor's previous collaborative attempt to address guardrail impact at the head by slowly tapering the head of the guardrail to ground level with a drop-down section that extends the guard rail to the ground.

The current invention incorporates a novel way to implement tension; thereby representing an improvement on the current state of the art. This system utilizes an impact head to flatten the guardrail and also to guide the flattened guardrail through the front of the impact head, the tension is constantly maintained. Instead of passing the rail element out of the side of the terminal, as is done in several of the above mentioned methods, passing the flattened rail through the front of the terminal provides a superior structure for dissipating energy while minimizing the risk of the rail penetrating into the occupant compartment or cutting critical vehicle structural elements, such as the gasoline tank or break lines. A connector member attached to the guardrail and secured to the ground provides tension to hold the guardrail and prevent buckling. The preferred connector is a plurality of flat steel straps attached to the leading edge the W beam and bolted to an anchor in the ground in front of the terminal head. The straps provide the tension necessary for the impact head flatten the guardrail. Further by twisting each strap 90° and bolting it to the top of the anchor post set into the ground in front of the terminal head, the rail element is forced to twist ninety degrees until it is flat against the ground as it is pulled out the front of the terminal head.

The combination of using flat straps to enable the guardrail to twist and incorporating an oversized open front of impact head allows the new system to prevent the guardrail element from becoming entangled in front of the vehicle while it is in contact the impact head. The open front design enables a much stronger connection between the front of the impacting vehicle and the impact head that will assure the impact head does not twist as the guardrail passes through. Further, the flattening and twisting of the W beam as it passes through the impact head increase the energy dissipation of terminal system. It should be noted that placing the bottom of the impact head closer to the ground or passing the guard rail out of the bottom of the impact head increases the likelihood the vehicle will roll over the guard rail.

A further purpose and object of the invention is to address reverse direction impacts, that is, impacts to the guardrail from the direction opposite the one the guardrail is set up to primarily provide for. The present invention has additional structure is incorporated into the design to address this in an improved way. In this situation a vehicle that is traveling in the reverse direction strikes the face of the guardrail downstream from the terminal impact head.

When a vehicle strikes the rail in this manner at sufficient speed, the impact head can be projected to the end of the steel straps and become lodged on the anchor where it would again be struck by the impacting vehicle. Because the terminal head is likely to be essentially immovable when it is struck the second time, the guardrail rollover increases greatly. The solution to this problem is to provide a detachable connection between the guardrail and the end of the feeder chute on the impact head. Bolt slots in the guardrail impact head anchor bracket opening toward the front provide the secure fastening from one direction while allowing detachment in another direction. The impact head is securely anchored to the rail element during the reverse direction impacts because the bolts between the guardrail and the reverse direction bracket bear against the impact head. When the impact head is pushed down the guardrail the bolts slide out of slots in the reverse direction bracket.

Another option for reducing the risk associated with a reverse direction (rearward) impact is to allow the bolts attaching steel straps to the anchor to release when the impact head is pushed between the anchor post straps. A hole with an oversized key way is sufficient to produce this behavior, as is turning the slots rearward. There are a number of detachment/restraint system options which would prevent the head from moving off the guardrail.

THE PREFERRED EMBODIMENT

Figure 1:
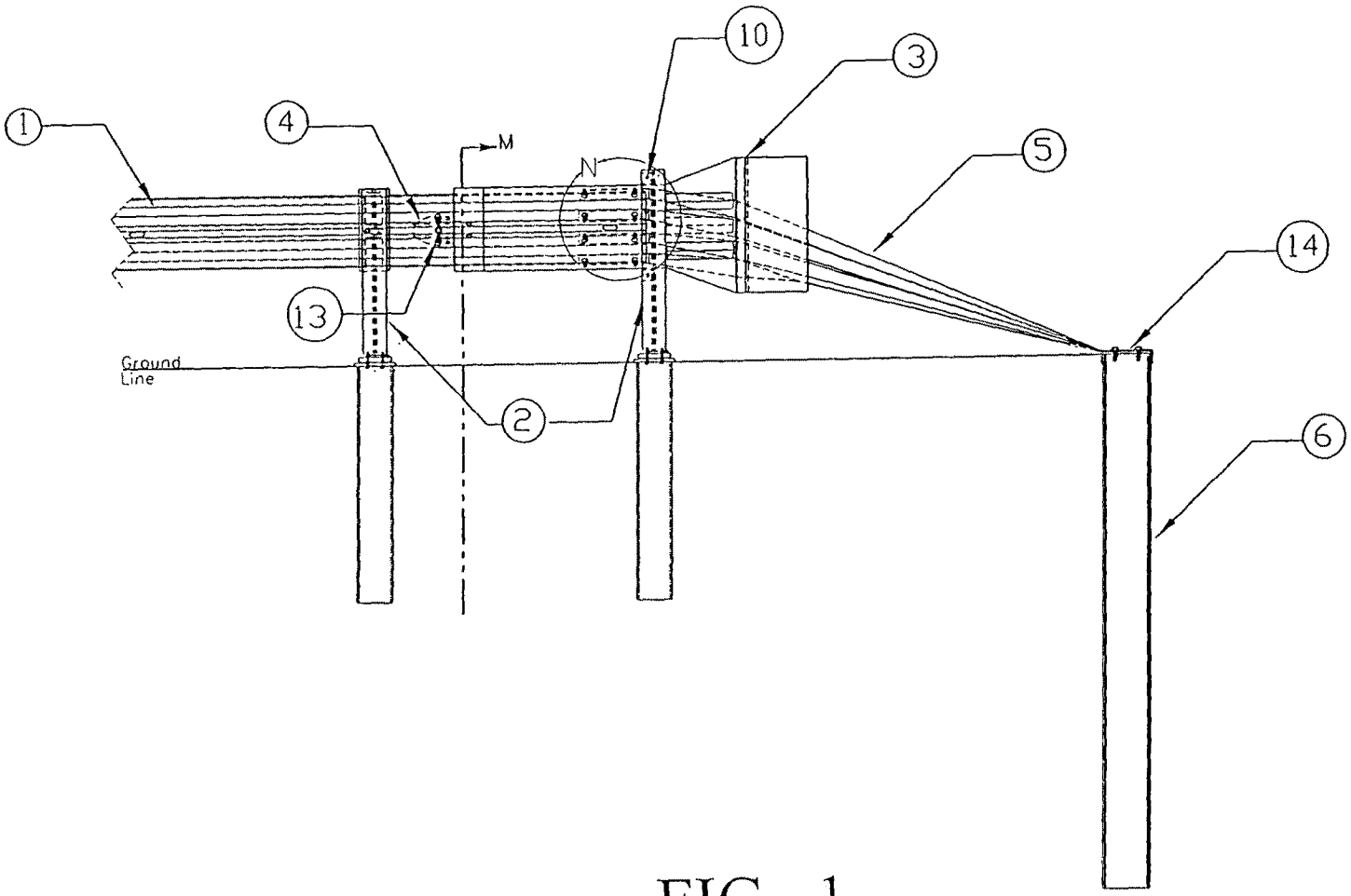
FIG. 1 shows a side view of the guardrail end, the last two support posts adapted to safely shear away and the post mounted in the ground in front of the impact head with the flat strips anchored to it.
Figure 2:
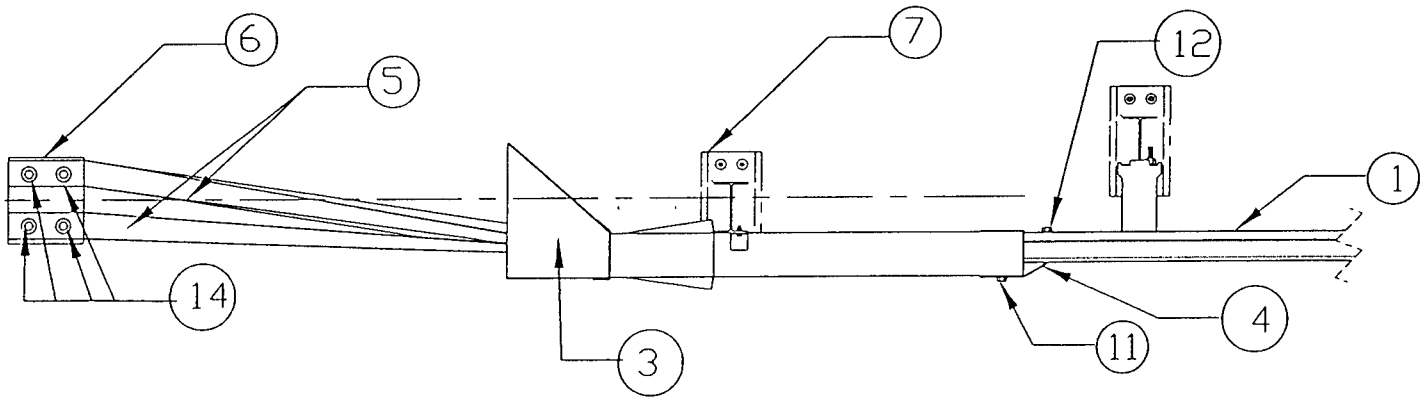
FIG. 2 is a top view of the guardrail end, the last two support posts adapted to safely shear away and the post mounted in the ground in front of the impact head with the flat strips anchored to it.
Figure 3:
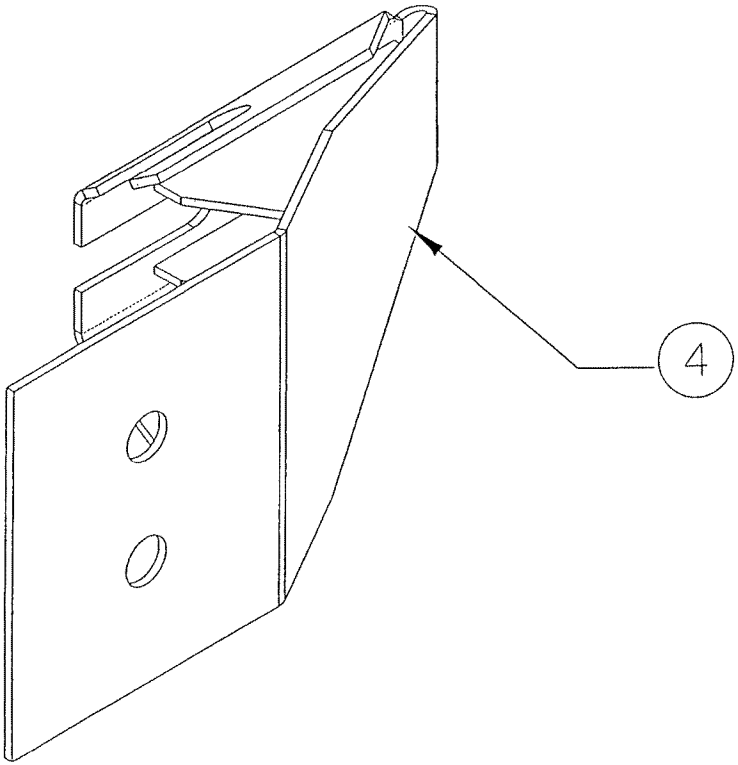
FIG. 3 shows the reverse direction bracket.

Guardrail 1, formed as a W (cross section) beam, is supported by a plurality of support posts 2. Impact head 3 is attached to the guardrail 1 by bolts, screws, rivets, nails, glue or welding. In the preferred embodiment, bolts 10 are the means to attach impact head 3. Reverse direction bracket 4 connecting impact head 3 to guardrail 1 is adapted with slotted bolt holes such that the slots open forward (toward the oncoming traffic). Reverse direction bracket 4 is attached to impact head 3 by means of attachment such as bolts, screws, or rivets. In the preferred embodiment bolts 11 are the means of attachment. Reverse direction bracket 4 is then attached to guardrail 1 by bolts 12 through the slotted bolt holds. Any slidably attached method would work such as bolts, rivets, nails, or screws as long as the method fits into the slots and as long as it allows for the reverse direction bracket to slide relatively easily when hit in the direction of oncoming traffic (forward). Near reverse direction bracket 4, impact head 3 is attached to guardrail 1 by any suitable means such as welding, screws, bolts, nails or glue. In the preferred embodiment, bolts 13 are the attachment means.

Figure 5:
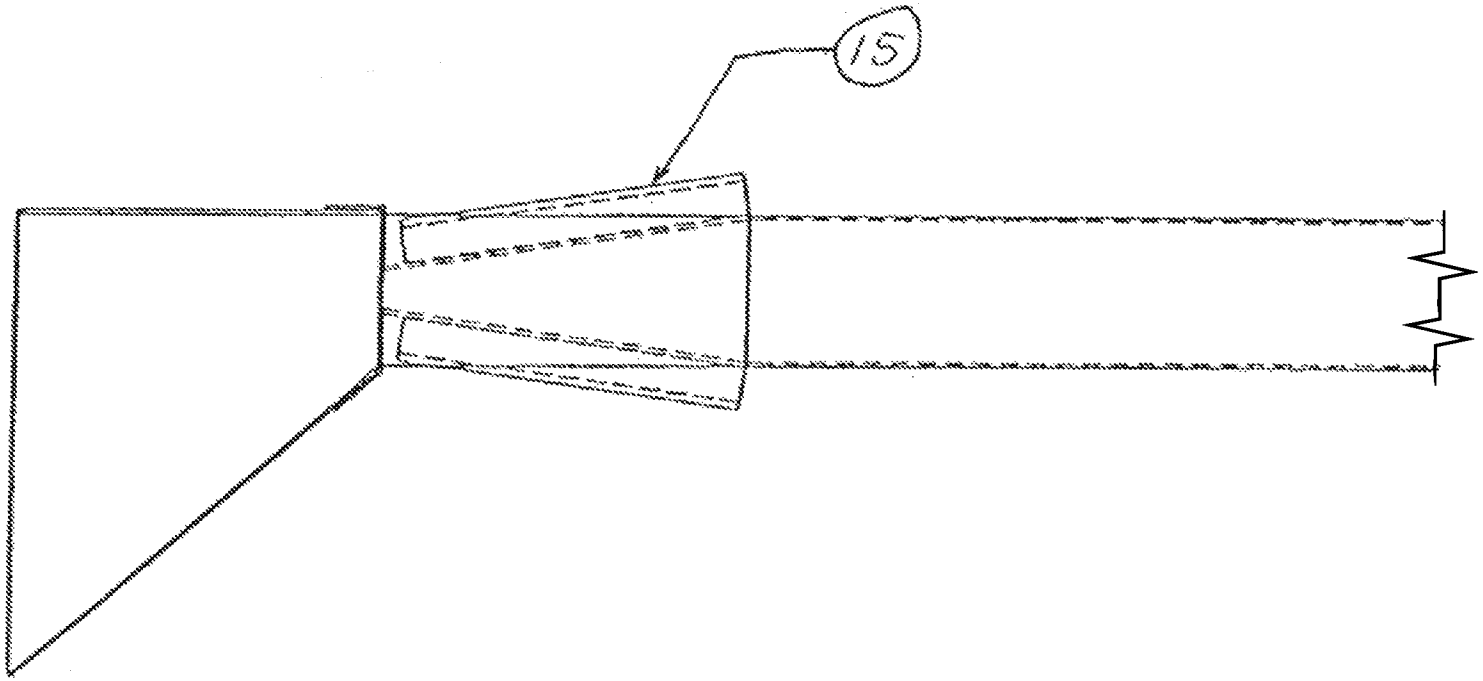
FIG. 5 shows the bottom view of the end terminal with the interior throat which compresses the W beam and guides it to remain within the terminal.

Reverse direction bracket 4 is adapted to be wedge shaped and attached with the wider part of the wedge shape at the forward end in order to channel the bumper or fender of a vehicle colliding with the guardrail from the opposite direction of the usual direction of travel. Impact head 3 is adapted to flatten the W beam guardrail 1 as it moves down the guardrail when impacted by a object in the front. This is accomplished by having the inside of rear portion 15 shaped like a funnel with the narrow end facing the oncoming traffic direction (forward) as shown in FIG. 5.

Figure 4:
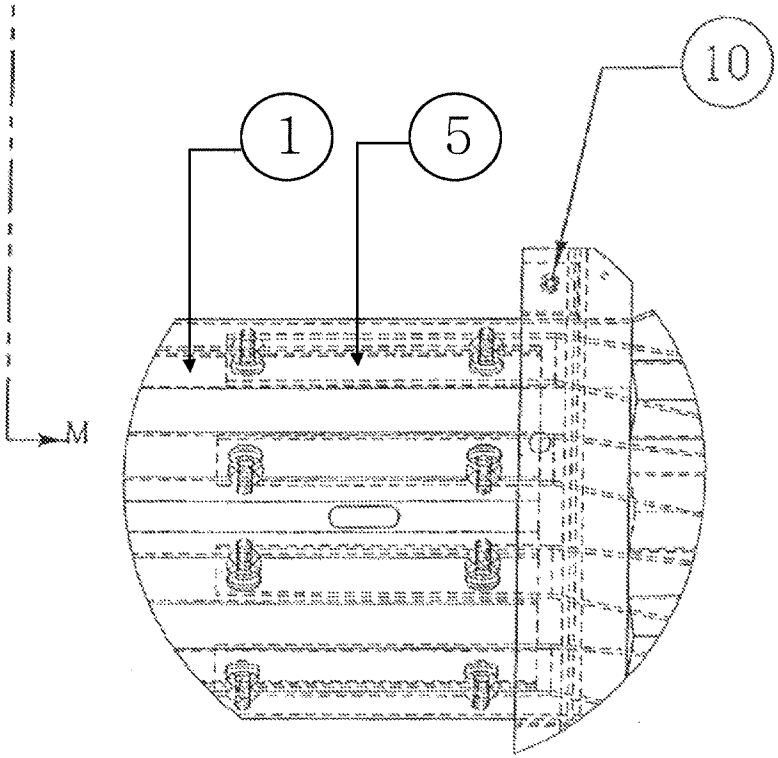
FIG. 4 shows the fastening of the flat straps to a W beam.

At least one, but preferably a plurality, of flat strips 5, made of high toughness and tensile strength material, are attached to guardrail 1. FIG. 4 shows the strips attached to the W beam with bolts. Wire rope, cable, or other similar means of providing tension will suffice to create tension but will not twist the guardrail as it is moved under impact. Best results in protecting the occupants are obtained by flattening and twisting the guardrail ninety degrees so it is roughly parallel to the road. Front anchor post 6 is embedded in the ground with only the connector plate portion of it above ground or under ground near the surface. Each of the flat strips 5 that are attached to guardrail 1 extend through the front of impact head 3, are twisted ninety degrees relative to the plane of guardrail 1, and are attached to front anchor post 6. Any means of attachment is sufficient such as welding, rivets, bolts, screws, nails or glue. The preferred embodiment attaches flat strips 5 to front post 6 with bolts 14.

First support post 7 is placed behind impact head 3 embedded into the ground and attached to guard rail 1.

I claim:

1. A twist box guardrail terminal comprising:

a guardrail formed as a beam;

an impact head of open front configuration receiving the guardrail therethrough, and adapted to flatten the beam as the impact head moves down the beam when impacted by a vehicle from an oncoming traffic direction;

a wedge shaped reverse direction bracket attached to the impact head and attached to the beam, the reverse direction bracket comprising a first portion fixedly attached to the impact head, a second portion attached to the beam, and an angled portion connecting the first and second portions at rear ends thereof opposite to the oncoming traffic direction, and defining a wider part of the wedge shape at the end of the bracket facing oncoming traffic, wherein the second portion includes slotted bolt holes having slot openings at a forward end thereof open to the oncoming traffic direction, and the reverse direction bracket is attached to the beam with bolts mounted through the slotted bolt holes;

a front anchor embedded in the ground; and a connector member attached to a forward end of the guardrail facing the oncoming traffic direction, the connector member extending from the guardrail through the open front of the impact head and being attached to the front anchor, wherein the reverse direction bracket provides an initial braking force by being configured such that the bolts slide out of the slotted bolt holes upon an impact to the impact head by a vehicle from the oncoming traffic direction, and wherein upon impact from a vehicle to the impact head, movement of the bolts within the slotted bolt holes enables the impact head to be pushed in a direction parallel to oncoming traffic such that the beam is pulled through the open front of the impact head.

2. A twist box guardrail terminal as set forth in claim 1, wherein the impact head includes a funnel-shaped rear portion disposed with the narrow end of the funnel facing forward.

3. A twist box guardrail terminal as set forth in claim 1, wherein the impact head includes a rear portion in the shape of a partial funnel, straight at the top and bottom but sloped along the sides, with the narrow end of the partial funnel facing forward.

4. A twist box guardrail terminal as set forth in claim 1, wherein the connector member is a flat strip attached to the guardrail such that the flat strip extends from the guardrail through the open front of the impact head and are attached to the front anchor.

5. A twist box guardrail terminal as set forth in claim 1, wherein the connector member is a plurality of flat strips attached to the guardrail such that the plurality of flat strips extend from the guardrail through the open front of the impact head and are attached to the front anchor.

6. A twist box guardrail terminal as set forth in claim 1, wherein the connector member is a plurality of flat strips attached to the guardrail such that the plurality of flat strips extend from the guardrail through the open front of the impact head, are turned 90 degrees relative to the plane of the beam, and are attached to the front anchor post.

7. A twist box guardrail terminal as set forth in claim 1, wherein the connector member is a plurality of wire strips attached to the guardrail such that the plurality of wire strips extend from the guardrail through the open front of the impact head and are attached to the front anchor.

8. A twist box guardrail terminal as set forth in claim 1, wherein the connector member is a plurality of cables attached to the guardrail such that the plurality of cables extend from the guardrail through the open front of the impact head and are attached to the front anchor.

9. A twist box guardrail terminal as set forth in claim 1 further comprising:

the front anchor being a post embedded in the ground.

10. A twist box guardrail terminal as set forth in claim 1 further comprising:

the front anchor being embedded in the ground adapted with a connector plate portion of it above ground.

11. A twist box guardrail terminal as set forth in claim 1 further comprising:

the front anchor being embedded in the ground adapted with a connector plate portion of it below ground.

12. A twist box guardrail terminal comprising:

a guardrail formed as a W beam;

an impact head of open front configuration receiving the guardrail therethrough, and adapted to flatten the beam as the impact head moves down the beam when impacted by a vehicle from an oncoming traffic direction, the impact head including a funnel-shaped rear portion disposed with a narrow end of the funnel facing forward toward the oncoming traffic direction;

a wedge shaped reverse direction bracket comprising a first portion fixedly attached to the back of the impact head, a second portion attached to the guardrail, and an angled portion connecting the first and second portions at rear ends thereof opposite to the oncoming traffic direction, and defining a wider part of the wedge shape at the end of the bracket facing oncoming traffic, wherein the second portion includes slotted bolt holes having slot openings at a forward end thereof open to the oncoming traffic direction;

bolts attaching the reverse direction bracket to the guardrail through the slotted bolt holes in the reverse direction bracket;

bolts attaching the impact head to the reverse direction bracket;

a plurality of flat strips;

a front anchor post embedded in the ground and including a connector plate portion;

bolts attaching the flat strips to a forward end of the guardrail facing the oncoming traffic direction such that each of the flat strips are twisted ninety degrees relative to the plane of the guardrail and extends through the open front of the impact head; and bolts attaching the flat strips to the front anchor post, wherein the reverse direction bracket provides an initial braking force by being configured such that bolts slide out of the slotted bolt holes upon an impact to the impact head by a vehicle from the oncoming traffic direction, and wherein upon impact from a vehicle to the impact head, movement of the bolts within the slotted bolt holes enables the impact head to be pushed in a direction parallel to oncoming traffic such that the beam is pulled through the open front of the impact head.

13. A twist box guardrail terminal comprising:

a guardrail formed as a W beam;

an impact head of open front configuration receiving the guardrail therethrough, and adapted to flatten the beam as the impact head moves down the beam when impacted by a vehicle from an oncoming traffic direction, the impact head including a rear portion in the shape of a partial funnel such that the top and bottom are straight but the sides narrow, with a narrow end of the funnel facing forward toward the oncoming traffic direction;

a wedge shaped reverse direction bracket comprising a first portion fixedly attached to the back of the impact head, a second portion attached to the guardrail, and an angled portion connecting the first and second portions at rear ends thereof opposite to the oncoming traffic direction, and defining a wider part of the wedge shape at the end of the bracket facing oncoming traffic, wherein the second portion includes slotted bolt holes having slot openings at a forward end thereof open to the oncoming traffic direction;

bolts attaching the reverse direction bracket to the guardrail through the slotted bolt holes in the reverse direction bracket;

bolts attaching the impact head to the reverse direction bracket;

a plurality of flat strips;

a front anchor post embedded in the ground including a connector plate portion;

bolts attaching the flat strips to a forward end of the guardrail facing the oncoming traffic direction; and bolts attaching the flat strips to the front anchor post such that each of the flat strips is twisted ninety degrees relative to the plane of the guardrail and extends through the open front of the impact head before being attached to the front anchor post, wherein the reverse direction bracket provides an initial braking force by being configured such that bolts slide out of the slotted bolt holes upon an impact to the impact head by a vehicle from the oncoming traffic direction, and wherein upon impact from a vehicle to the impact head, movement of the bolts within the slotted bolt holes enables the impact head to be pushed in a direction parallel to oncoming traffic such that the beam is pulled through the open front of the impact head.

* * * * *